US005887860A

United States Patent [19]

Hong

[11] Patent Number: 5,887,860

[45] Date of Patent: Mar. 30, 1999

[54] INCREMENTAL MULTIPLE-FORCED VISE OF EPICYCLIC GEAR TRAIN TYPE

[75] Inventor: Ching-Wen Hong, Taichung Hsien, Taiwan

[73] Assignee: Safeway Machinery Industry Corporation, Taichung Hsien, Taiwan

[21] Appl. No.: 835,517

[22] Filed: Apr. 8, 1997

[51] Int. Cl.[6] ..... B25B 1/06

[52] U.S. Cl. ..... 269/225; 269/244; 269/228

[58] Field of Search ..... 269/244, 246, 269/225, 228

[56] References Cited

U.S. PATENT DOCUMENTS

| | | | |
|---|---|---|---|
| 4,046,364 | 9/1977 | Coope et al. | 269/244 |
| 4,770,401 | 9/1988 | Donaldson | 269/246 |
| 5,171,004 | 12/1992 | Berchtold | 269/244 |

*Primary Examiner*—Robert C. Watson

*Attorney, Agent, or Firm*—Bacon & Thomas, PLLC

[57] ABSTRACT

An incremental multiple-forced vise of epicyclic gear train type mainly comprises basic components of vise's main body and movable jaw etc. to accommodate a lead screw, two sets ( i.e. double-layer ) of epicyclic gear train and a buffer device. By applying force to the handle and through the buffer device as well as the double-layer epicyclic gear train, it can drive the lead screw to turn, thereby, to make the double hook, movable jaw and jaw plate to move until it touches the workpiece, thereafter, one can keep on applying force to the handle and by using the buffer device and the double layer epicyclic gear train to generate incremental multiple force and transmit the force to the lead screw so as to let the workpiece gain huge incremental multiple clamping force; on the contrary, if one turns the handle in counter-clockwise direction, the incremental multiple-forced function of the double-layer gear train will retreat back to zero in order to release the workpiece, thereby, it is very simple and labour-saving in performing the clamping and releasing operation as well as in creating huge clamping force.

4 Claims, 9 Drawing Sheets

INCREMENTAL MULTIPLE-FORCED VISE OF EPICYCLIC GEAR TRAIN TYPE

BACKGROUND OF THE INVENTION

1. Field of the Invention

The present invention is a vise having a force multiplying gear train that includes two sets of epicyclic gears, a buffer device to accommodate a driving handle and a lead screw, and a visible scale that displays the force applied to the lead screw. The gear ratio of the epicyclic gear train provides the multiplying force transmitted to the lead screw and the the scale provides a direct reading of the applied force so that consistent clampling forces are applied to successive workpieces.

2. Description of the Prior Art

Vises of the prior art generally use a fixed jaw together with a movable jaw driven by a screw to generate displacement and to obtain clamping force. Although hydraulic vises have a high clamping force, they require a lot of maintenance because the frequency of oil leaks is rather high. Insufficient oil requires the operator to stop a hydraulic vise to perform maintenance, which increases manufacturing costs.

SUMMARY OF THE INVENTION

The primary objective of the present invention is to provide a force multiplying vise having an epicyclic gear train in which the force multiplication is attained by the gears of the epicyclic gear train. The vise not only can obtain high clamping forces, but the problem created by leaking hydraulic fluid is eliminated. In addition, the practical use of the gears of an epicyclic gear train provides a simple, durable, overall structure, having high precision, low repair frequency and low construction cost.

Another objective of the present invention is to provide a design of a force multiplying epicyclic gear train vise which includes a scale ring showing the magnitude of the clamping force by using two or more sets of reduction epicyclic gears, where the rotation of the gear train drives the scale ring. Thus, the scale ring clearly shows the magnitude of clamping force so that the operator can control the magnitude of the clamping force without being concerned with how tightly the workpiece is clamped.

For these reasons and in order to disclose the objectives, characteristics and efficacies of the present invention, the author herewith presents a detailed and clear illustration together with the accompanied drawings:

DETAILED DESCRIPTION OF THE PREFERRED EMBODIMENT

Figure 6:
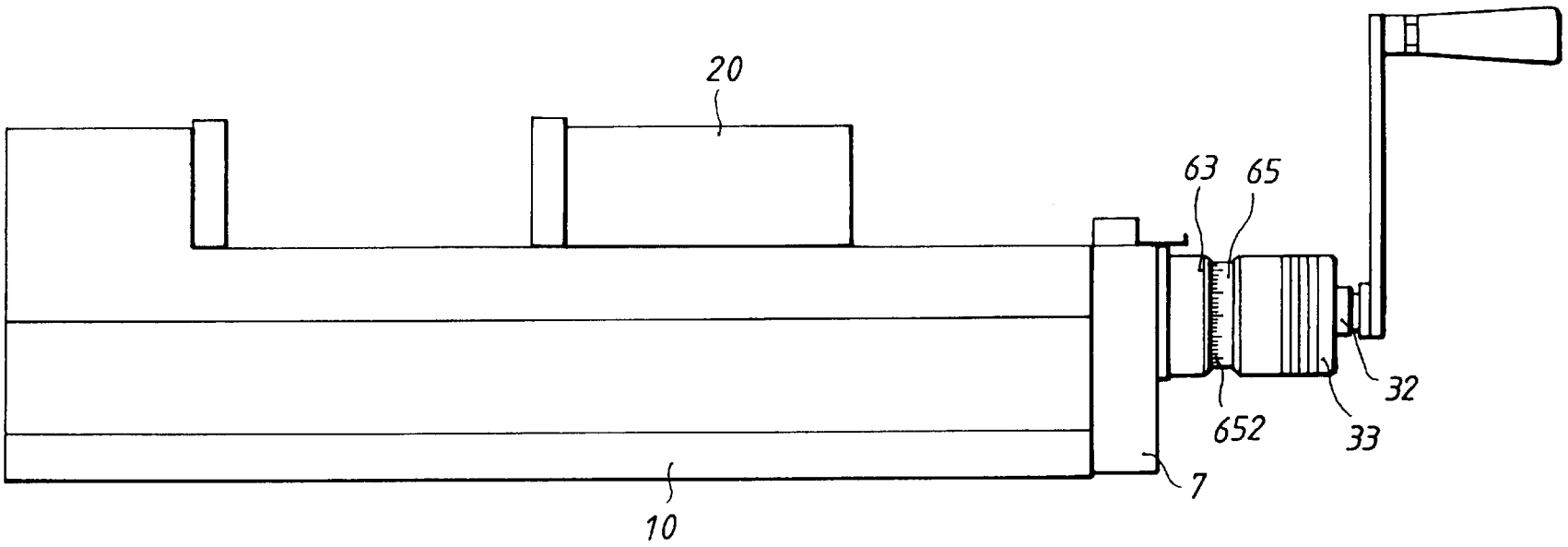
FIG. 6 is the front view of the assembly of the present invention.

As shown in FIGS. 1 through 4, the present invention includes the basic components of a vise's main body 10 and a movable jaw 20 which accommodate a lead screw 1, two sets (i.e., a double-layer type) of an epicyclic gear train and a buffer device, where the basic components of the main body 10 and movable jaw 20 are functionally equivalent to those of the prior art and can be combined with other mechanisms. The present invention is aimed at the combined structure of lead screw 1, two sets (i.e., double layer type) of epicyclic gear train and a buffer device to provide a driving handle 4, as shown in FIG. 6.

Figure 1:
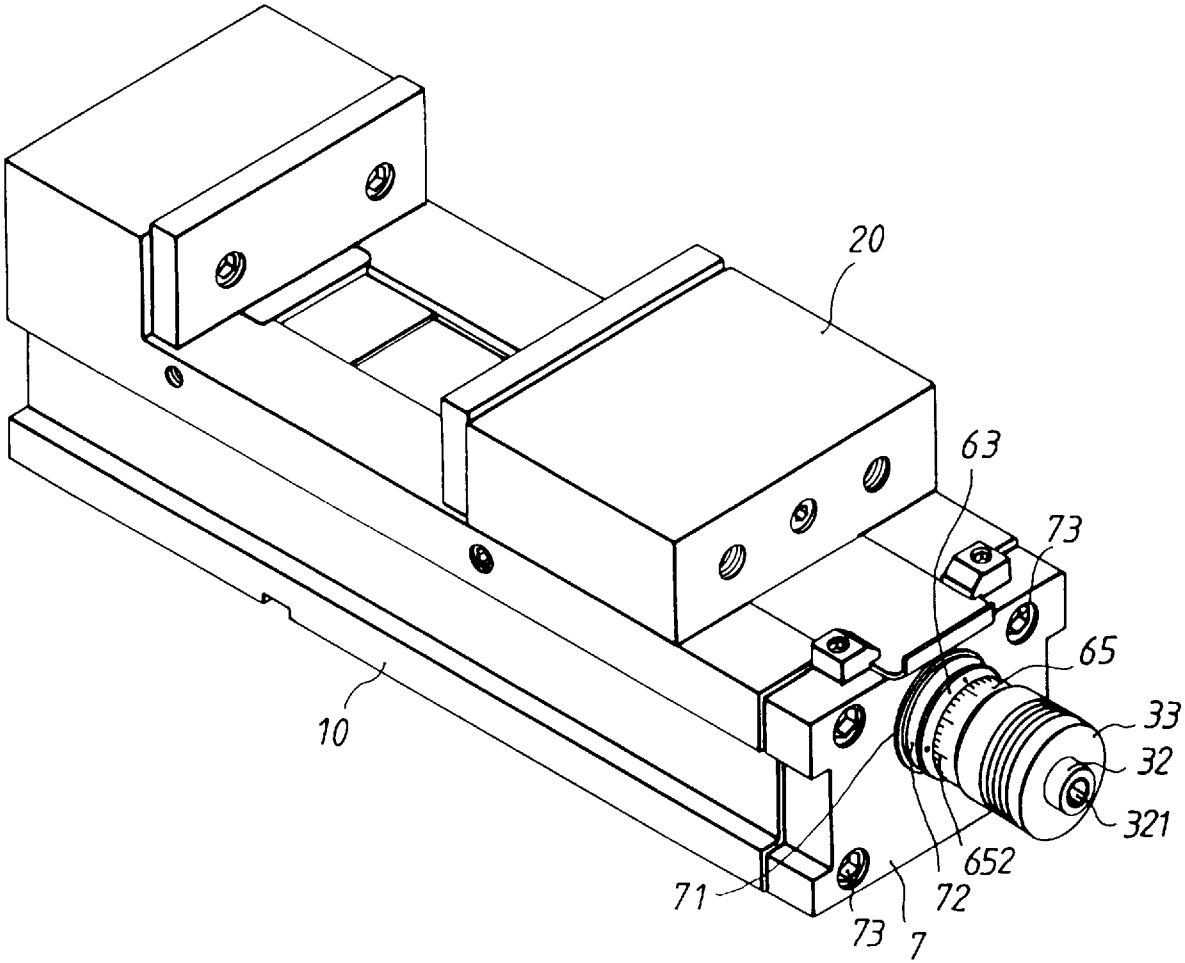
FIG. 1 is the isometric assembly drawing of the present invention.
Figure 2:
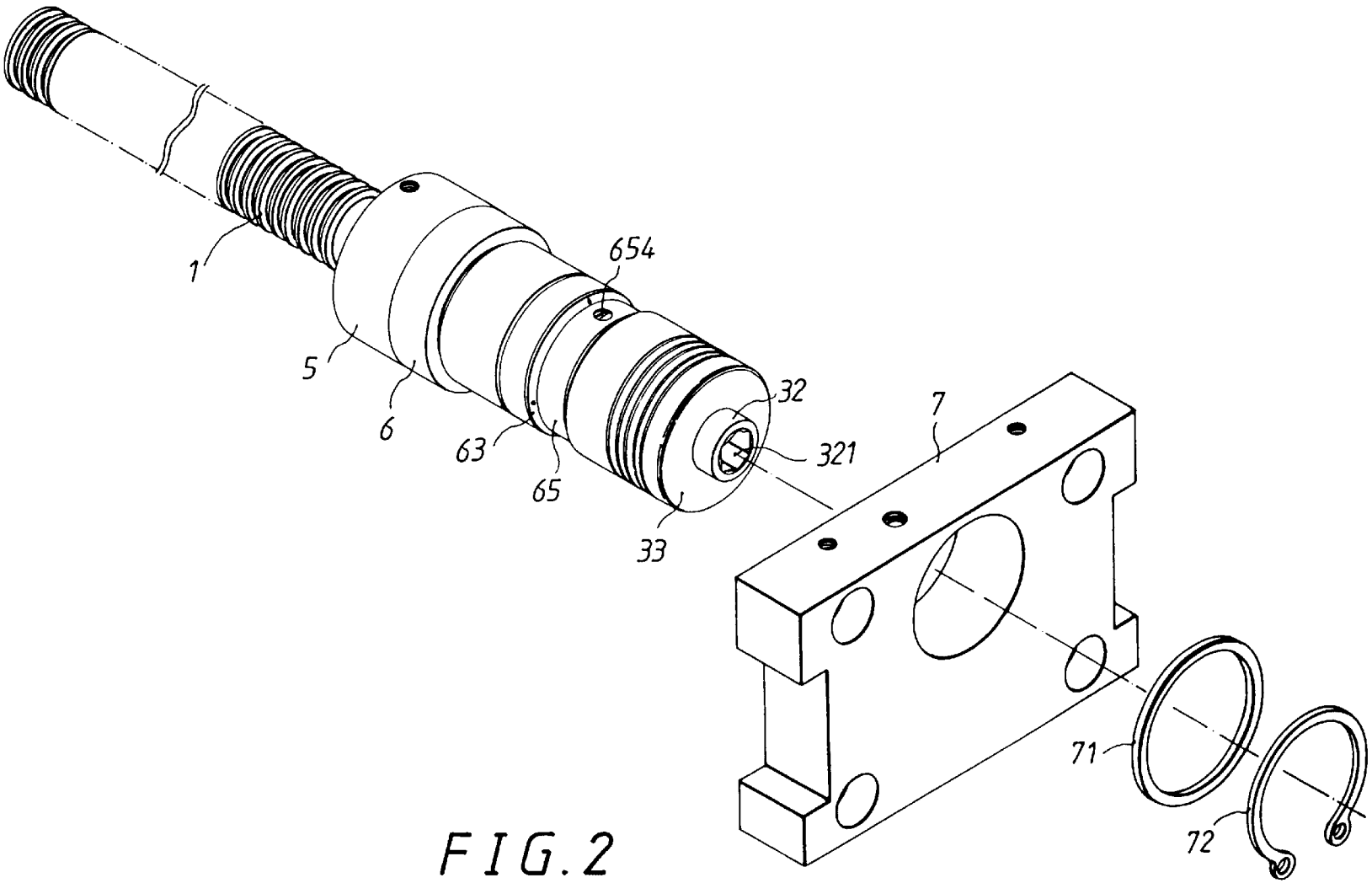
FIG. 2 is the isometric disassembled drawing showing the force multiplying device and a lead screw supporting plate of the present invention.
Figure 3:
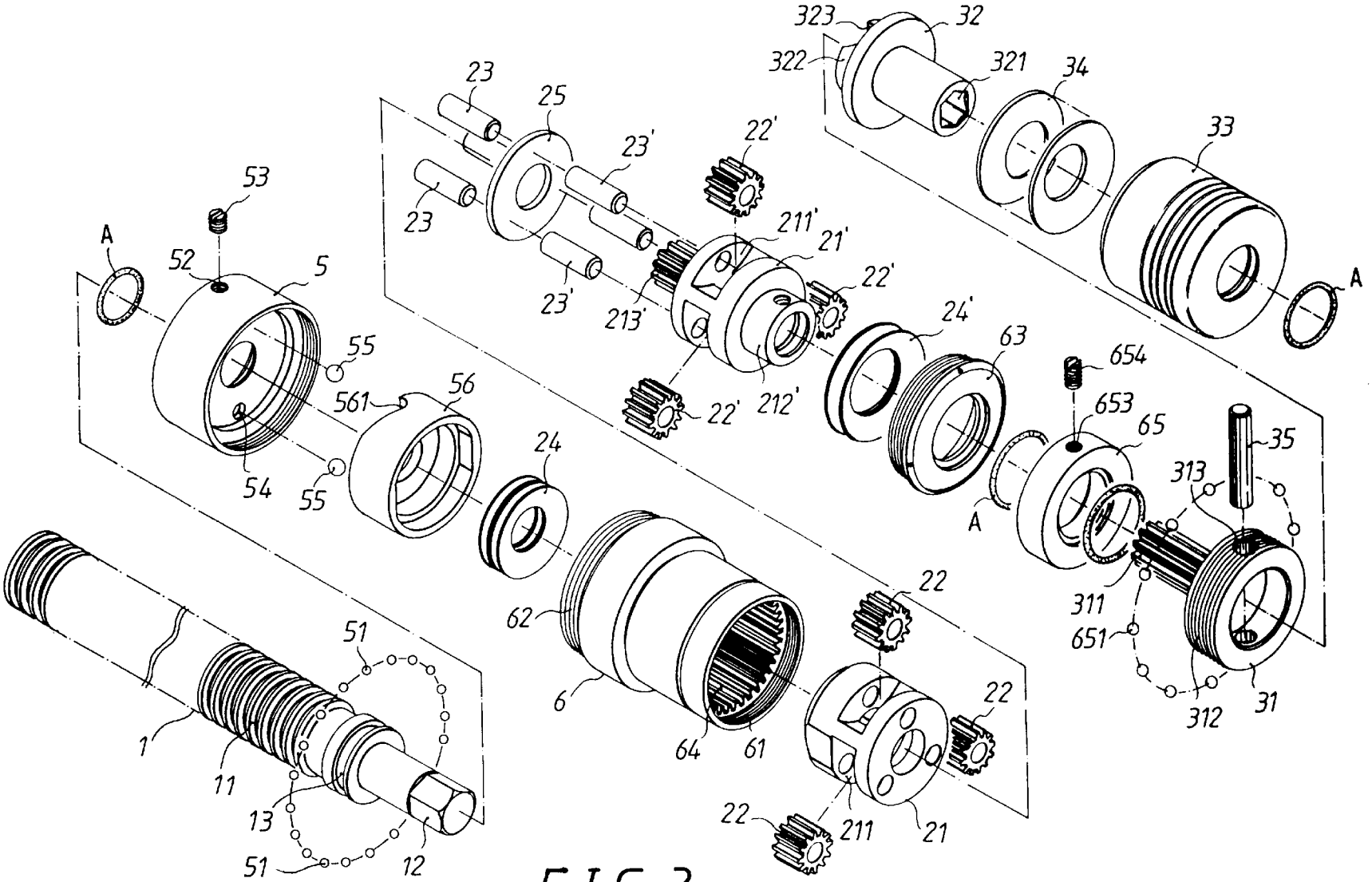
FIG. 3 is the exploded view of the present invention.
Figure 4:
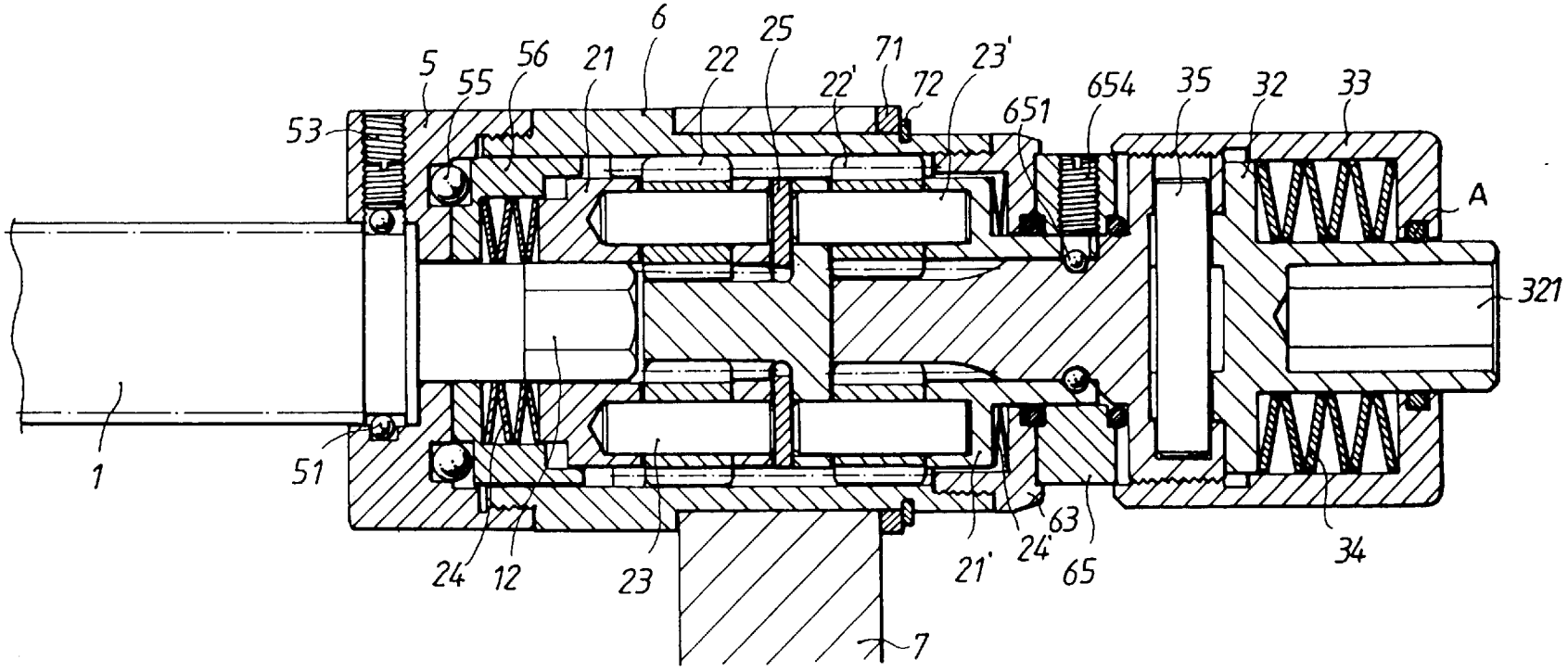
FIG. 4 is the longitudinal sectional view of the assembly of the present invention.

FIGS. 1–3 show lead screw 1, which penetrates through and meshes with movable jaw 20 set up by the vise's main body 10, is arranged to cause the movable jaw 20 to have axial displacement along its thread section 11 when lead screw 1 rotates. One end of the lead screw 1 sets up hexagonal strut 12 which plugs into an epicyclic gear train. Near the hexagonal strut 12 is a steel ball annular groove 13 cooperating with a dust guard cover 5 having a steel ball inner groove corresponding to the steel ball annular groove 13, which allows a plurality of steel balls 51 to be inserted through a hole 52 in the exterior wall of the dust guard cover 5 and locked therein by a fixing screw 53. Two circular grooves 54 are also inside the dust guard cover 5 to allow two steel balls to be seated to a depth of half of their diameters, with their other halves fitted in two curve-arc grooves 561 set up at one end of the adjacent clutch ring 56 to become a movable contact assembly, as shown in FIG. 3 and FIG. 4.

Figure 5:
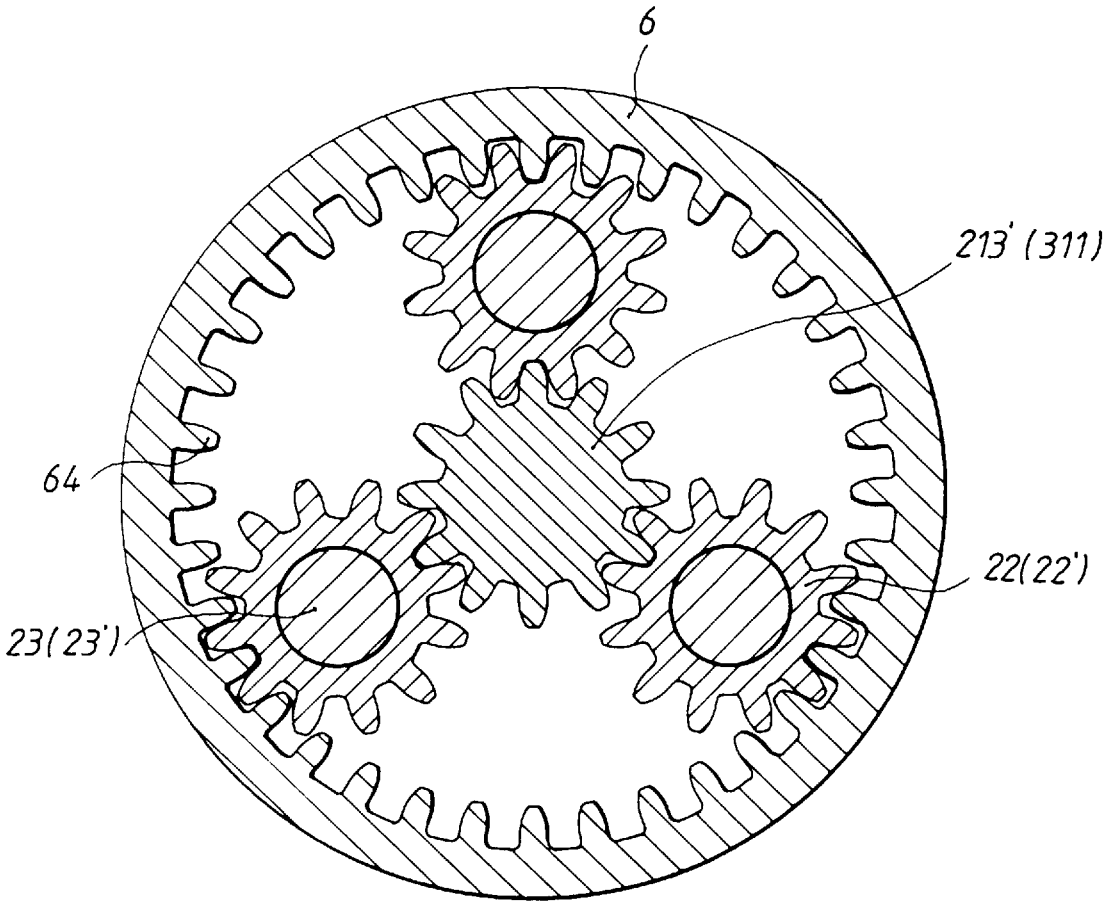
FIG. 5 is the sectional view of the assembly of the epicyclic gear train of the present invention.

Two planetary gears of two sets of epicyclic gear trains engage with internal splines (grooves) of sleeve 6, which is a stepped sleeve ring with interior thread 61 at its front end which meshes with exterior threads of a scale reset ring 63. Sleeve 6 also has an exterior thread 62 at its rear end to mesh with internal threads of the above-mentioned dust guard cover 5. The epicyclic gear train on the inner side has an internal hexagonal ring 21, a plurality of gears 22 and straight pin 23 and a disk spring 24. Among them, the internal hexagonal ring 21, having three plug-in grooves 211 in equal division, forms a cage to receive the three gears 22, each positioned by a straight pin 23, as shown in FIGS. 3, 4 and 5. The other member of the epicyclic gear train set located on the outer side, which is similar to the above-mentioned gear train, comprises a gear 21' instead of the internal hexagonal ring 21, a plurality of gears 22', straight pin 23' and a disk spring 24' in equal division which forms a cage to receive the three gears 22', positioned by a straight pin 23', as shown in FIGS. 3, 4 or 5. The difference between the gear ring 21' and the internal hexagonal ring 21 is that a small protruded ring 212' is at the front end and an extended gear shaft 213' is at the rear end, respectively. There is a washer 25 between the two sets of epicyclic gear trains to serve as a separator while the disk springs 24 and 24' bias the clutch ring 56 and the scale reset ring 63, respectively. Also, the internal hexagonal ring 21 is provided for the lead screw 1 to plug into and is positioned such that the gears 22 and 22' can mesh with the axial gear spline 64 in the internal annular wall of the internal gear shaft sleeve 6, as shown in FIG. 4 and FIG. 5.

FIG. 3 shows a buffer device, which comprises a gear clutch ring 31, an internal hexagonal clutch ring 32, a sleeve barrel 33, a disk spring 34 and a straight pin 35, where the gear clutch ring has an external thread 312 at one end to mesh with the internal thread of the sleeve 33, to be tightened together with two pin holes 313 at the top and bottom to accommodate a straight pin 35 penetrating in a radial direction. The gear clutch ring 31 has an extended gear shaft 311 at the other end with a steel ball annular groove to allow the steel balls 651 of a scale ring 65 to fit into, as shown in FIG. 4. The internal hexagonal clutch ring 32 includes a stepped sleeve with the small stepped ring having an internal hexagonal groove 321 at one end to allow a driving handle 4 (as shown in FIG. 6) to fit in. The other end of the internal hexagonal clutch ring 32 has an annular convex portion 322 which also has two corresponding arc-curve grooves 323 to exactly contact the straight pin 35 to function as a clutch. The disk springs 34 are biased against the internal wall of sleeve barrel 33 and the gear clutch ring 31 to provide flexible biasing effect.

Figure 9:
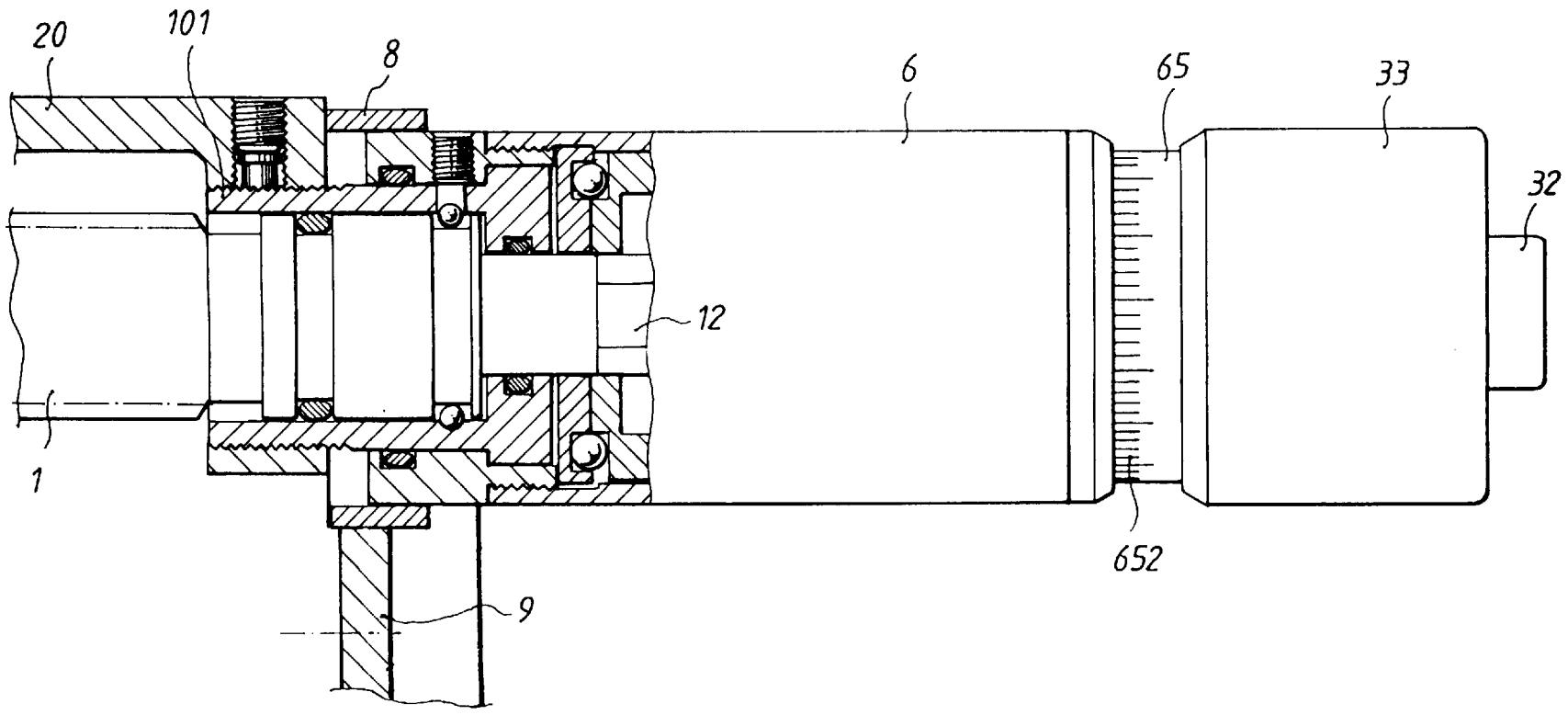
FIG. 9 is the schematic diagram of a sectional view of part of another embodiment of the present invention.

A scale ring 65 with appropriate preset scale label 652 (as shown in FIG. 9) at one of its ends on the outer ring can be inserted between the above-mentioned scale reset ring 623 and sleeve barrel 33. The scale ring 65 has a steel ball placing hole 653 in its wall to allow the insertion of a plurality of steel balls 651 and is locked by a fixing screw 654, such that the steel balls 651 are contained in the steel ball annular groove between the scale ring 65 and the gear clutch ring 31.

For all of the above-mentioned components, O-ring A can be installed at any appropriate location, wherever it is necessary.

The embodiment of the present invention, as shown in FIG. 1 through FIG. 5, makes use of the above-mentioned assembly together with a lead screw supporting plate 7, and by the use of washer 71 and snap ring 72 to accommodate the tightening of four threaded portions 73 to fix the overall force multiplying assembly (which comprises the lead screw 1, two sets of epicyclic gear trains and buffer device) to the vise's main body 10 (as shown in FIG. 1 and FIG. 2), such that the whole assembly can use the lead screw supporting plate 7 as a fulcrum (i.e., the fulcrum of reaction). To perform this assembly, as the handle 4 is plugged into the internal hexagonal clutch ring 32 and force is applied to rotate the handle 4, the whole lead screw 1 will turn, but the two sets of epicyclic gear trains installed inside will stand still. The movable jaw 20 is then advanced forward until it first contacts, and then clamps the workpiece. As the rotation continues, the force multiplying mechanism of the double-layer epicyclic gear train will produce a large magnitude of force. The large reduction ratio will let the lead screw 1 keep on turning and moving the movable jaw 20 such that it will produce a large clamping force. But this is just one of the embodiments of the force multiplying mechanism of the double-layer epicyclic gear train of the present invention which makes use of the lead screw supporting plate 7 as a fulcrum. It can have other forms and combinations, such as those shown in FIG. 7 and FIG. 8.

In accordance with the foregoing principle of operation, after the workpiece is first clamped, if the lead screw 1 keeps on turning, it will deform the disk springs 34 and will further adjust the applied force to the handle 4 and to the epicyclic gear train until they are in equilibrium to gain a larger clamping force. One can easily rotate the handle without applying a large force due to the reduction of ratio of the gear.

Also, the above-mentioned scale ring 65 is the clamping force of the workpiece (i.e., each graduation represents the magnitude of a clamping force indicated by a number). The graduation label 652 at one end of its outer ring accommodates the reset point labelled on the ring's end surface of the scale reset ring 63. When force is applied, the invention makes use of the turning of the reduction ratio of the epicyclic gear train to drive the scale ring 65 to instantly show the magnitude of the clamping force at all times with the figure of the graduation label 652, so that the operator can accurately control the required magnitude of clamping force without worrying about whether the workpiece is tightly clamped or not. This means of indicating the workpiece clamping force is an original and innovative application that is not found in any publication and application. It provides a quantitative reading of applied force during the clamping operation. In addition, the scale ring 65 is fixed to the gear ring 21 and is wedged into the arc-curve groove 323 of the gear clutch ring 32 to drive the gear ring 21 through the straight pin 35 of the buffer device. One can calculate the magnitude of the clamping force for each revolution of its rotation and engrave this figure on the ring. In this way, one can easily obtain the magnitude of the clamping force.

The applied force at the handle 4 is transmitted through the buffer device to the internal gear shaft sleeve 6. Then, the force is transmitted to the second layer of epicyclic gear train. At this moment, the internal gear shaft sleeve 6 is unable to keep on advancing forward but it applies force against the lead screw supporting plate 7 and uses it as a fulcrum because of the clamping of the workpiece. It makes use of the large reduction ratio of the epicyclic gear train to keep on turning the lead screw 1 to gain a very large clamping force. The force multiplication of the lead screw 1, by the use of the double-layer epicyclic gear train, is calculated as follows:

$$\text{Reduction Ratio} = 1 + \frac{36}{1} = 4$$

i.e., as the extended gear shaft 311 of the gear clutch ring turns a revolution, the gear ring 21 turns only ¼ of a revolution;

$$\text{Reduction Ratio} = 1 + \frac{36/12}{1} = 4$$

$$\frac{1/4}{4} = \frac{1}{16}\ \text{Revolution}$$

i.e., as the gear ring 21 turns ¼ of a revolution, the internal hexagonal ring 21 only turns 1/16 of a revolution. When a force of 30 kg is applied to the handle, if the length of the handle is 12.5 cm, then, the force gained by the second layer of the epicyclic gear train is:

$$30\ \text{kg} \times 12.5 \times 16 - 6000\ \text{kg/f}$$

Figure 7:
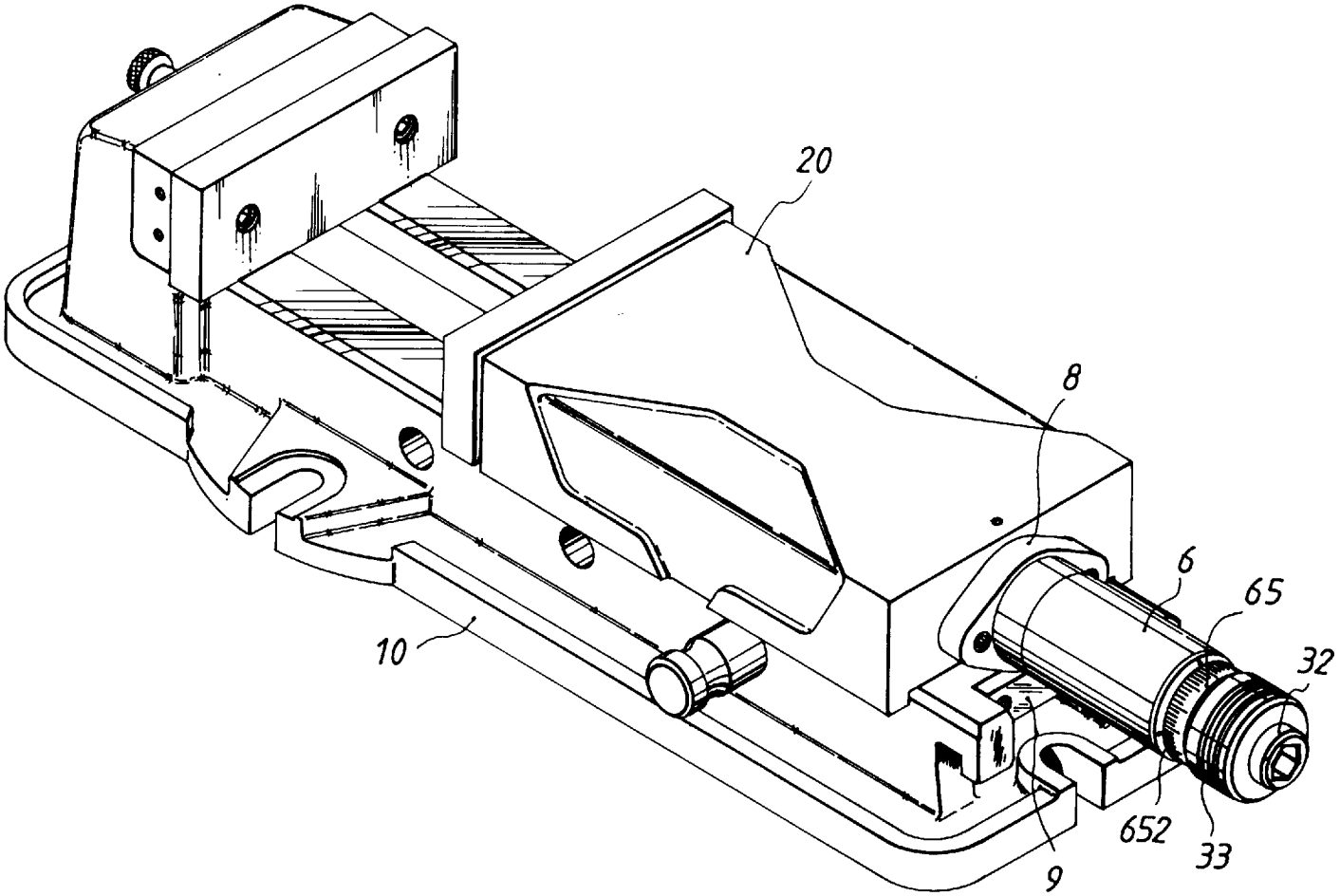
FIG. 7 is the isometric outward appearance of another embodiment of the present invention.
Figure 8:
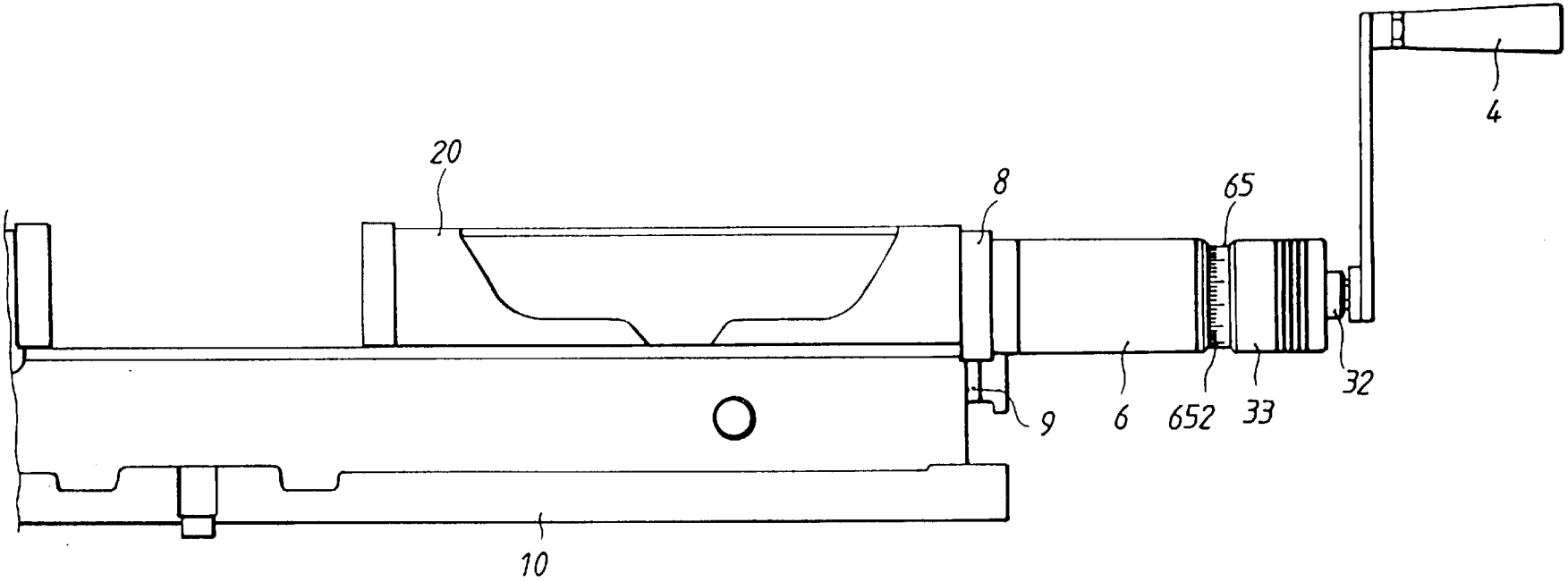
FIG. 8 is the front view of the assembly of another embodiment of the present invention.

The assembly of the foregoing embodiment is to fix the whole force multiplication mechanism, comprising the lead screw 1, two sets of epicyclic gear trains, and buffer device, etc., to the vise's main body 10, such that the overall clamping system can be supported by the lead screw supporting plate 7 and use it as a fulcrum. But actually, when it comes to actual application, the lead screw 1 can also move together with the movable jaw 20 to be the supporting fulcrum of the whole clamping system. In this way, the whole driving system can make the lead screw 1 move together with the movable jaw 20, which is another embodiment of the present invention, as shown in FIG. 7 and FIG. 8. In FIGS. 7–9, the lead screw 1 and the movable jaw 20 relative to the vise's main body 10 lock together by means of a supporting ring 101 to slip on, also it locks and positions the whole epicyclic gear train multiple-force assembly and by use of a stop piece 9 to lock beforehand at one side of the vise's main body 10. Thus, as one drives the handle 4, the lead screw 1 will move together with the movable jaw 20 and the stop piece 9 will limit the end-displacement of the whole epicyclic gear train, thereby avoiding falling off. After the lead screw 1, together with the movable jaw 20, touches the workpiece, it will take the movable jaw 20 function as a fulcrum to support, and thereby, to further start the force multiplying mechanism to generate incremental clamping.

Although the present invention has been illustrated and described previously with reference to the preferred embodiments thereof, it should be appreciated that it is in no way limited to the details of such embodiments, but is capable of numerous modifications within the scope of the appended claims.

What is claimed is:

1. An incremental multiple-force vise comprising:

a movable jaw;

a lead screw threadingly engaging said movable jaw for moving said movable jaw;

one or more gear trains rotatably coupled to said lead screw;

a buffer device rotatably releasably engaging a gear ring of one of said one or more gear trains, said buffer device arranged to receive a handle and absorb a clamping force following engagement of said movable jaw and said one or more gear trains;

a scale ring rotatably attached to said gear ring, wherein said scale ring displays preset indications of clamping force applied to the workpiece, whereby said preset indications are defined by calculations based on gear ratios, handle length and applied force.

2. The incremental multiple-force vise of claim 1, wherein:

said gear train is an epicyclic gear train.

3. The incremental multiple-force vise of claim 2, further comprising:

a second clutch rotatably releasably engaging said lead screw, said second clutch being driven by one of said one or more gear trains.

4. An incremental multiple-force vise comprising:

a lead screw threadingly engaging a movable jaw;

said lead screw having an annular groove aligned with an inner groove of a dust cover so that a plurality of steel balls are rotatably captured between said annular groove and said inner groove;

a clutch ring having two arc-curved grooves and clutch ring balls arranged to releasably lock between said two arc-curved grooves and a second set of grooves of said dust cover;

an internal grooved sleeve engaging said clutch ring at a first sleeve end and engaging a scale reset ring at a second sleeve end;

first and second epicyclic gear trains each located so that planetary gears of both gear trains engage with said internal grooved sleeve, a gear ring of the first gear train being engaged by an end of the lead screw;

a buffer device rotatably releasably engaging a gear ring of one of said first and second epicyclic trains, said buffer device arranged to receive a handle and absorb a clamping force following engagement of said movable jaw and said first and second epicyclic gear trains; wherein said buffer device includes a clutch ring, a sleeve containing axially aligned disk springs and a straight pin intersecting a gear clutch ring, wherein said sleeve engages said gear clutch ring and said disk springs bias an internal wall of said sleeve against said gear clutch ring, said handle arranged to drive said clutch ring thereby causing said clutch ring to rotatably releasably engage said straight pin and thereby drive said gear clutch ring;

said gear clutch ring includes an extended gear shaft which engages the gear ring of said second gear train; and a scale ring rotatably attached to said gear ring, wherein said scale ring displays preset indications of clamping force applied to the workpiece, whereby said preset indications are defined by calculations based on gear ratios, handle length and applied force.

* * * * *